United States Patent [19]

Yamamura

[11] Patent Number: 4,924,744

[45] Date of Patent: May 15, 1990

[54] APPARATUS FOR GENERATING SOUND THROUGH LOW FREQUENCY AND NOISE MODULATION

[75] Inventor: Kimio Yamamura, Tokyo, Japan

[73] Assignee: Hudson Soft Co., Ltd., Hokkaido, Japan

[21] Appl. No.: 230,342

[22] Filed: Aug. 9, 1988

[30] Foreign Application Priority Data

| | | | |
|---|---|---|---|
| Aug. 27, 1987 | [JP] | Japan | 62-213978 |
| Aug. 27, 1987 | [JP] | Japan | 62-213979 |
| Aug. 27, 1987 | [JP] | Japan | 62-213980 |
| Aug. 27, 1987 | [JP] | Japan | 62-213981 |
| Aug. 27, 1987 | [JP] | Japan | 62-213982 |
| Aug. 27, 1987 | [JP] | Japan | 62-213983 |

[51] Int. Cl.[5] ..... G10H 7/00; G10H 1/06; G10H 1/04; G10H 1/08

[52] U.S. Cl. ..... 84/601; 84/602; 84/622; 84/624; 84/625

[58] Field of Search ..... 84/1.22, 1.23, 1.25, 84/DIG. 12, DIG. 27, DIG. 1 Z, 1.27, 600–602, 604, 615, 617, 624, 625, 647, 655, 659, 660, 678, 682, 694, 697, 1.03; 381/1, 17, 51–53, 62; 369/4

[56] References Cited

U.S. PATENT DOCUMENTS

| | | | |
|---|---|---|---|
| 3,795,756 | 3/1974 | Suzuki | 84/1.22 |
| 3,878,472 | 4/1975 | Osakabe | 84/DIG. 27 |
| 4,258,602 | 3/1981 | Niimi et al. | 84/1.22 X |
| 4,300,225 | 11/1981 | Lambl | 369/4 X |
| 4,347,405 | 8/1982 | Davis | 84/DIG. 1 |
| 4,402,243 | 9/1983 | Deforeit | 84/624 X |
| 4,419,919 | 12/1983 | Kashio | 84/1.25 X |
| 4,554,854 | 11/1985 | Kato | 84/1.27 X |
| 4,577,540 | 3/1986 | Yamana | 381/1 X |
| 4,648,115 | 3/1987 | Sakashita | 381/17 |
| 4,685,134 | 8/1987 | Wine | 381/17 |
| 4,747,332 | 5/1988 | Uchiyama et al. | 84/655 |
| 4,754,680 | 7/1988 | Morikawa et al. | 84/1.22 |
| 4,821,326 | 4/1989 | MacLeod | 381/51 |

*Primary Examiner*—A. T. Grimley
*Assistant Examiner*—Matthew S. Smith
*Attorney, Agent, or Firm*—Lowe, Price, Leblanc, Becker & Shur

[57] ABSTRACT

In an apparatus for generating sound, there are provided a plurality of channels for generating sounds. Each of the channels includes a memory for storing waveform data, and at least one of the channels includes a noise generator so that various kinds of sounds including rhythm sound-effects sound, effects sound-vibrato etc. are generated. There is further provided a controller by which voice sound signal is passed through the channels so that artificial sound, voice sound etc. are generated. There is still further provided a circuit for adjusting an amplitude level of a whole sound which is obtained by mixing output sounds of the channels so that far and near sound is produced. Further, each of the channels includes left and right attenuators which divide a channel sound into left and right channel sounds. Still further, the apparatus comprises a low frequency oscillator for controlling a depth of frequency modulation, and a controller for writing sampling data of a predetermined waveform into serial addresses of a memory.

2 Claims, 7 Drawing Sheets

FIG. 2

| | REGISTERS | D7 | D6 | D5 | D4 | D3 | D2 | D1 | D0 |
|---|---|---|---|---|---|---|---|---|---|
| R0 | CHANNEL SELECTION | / | / | / | / | / | / | ch SEL | |
| R1 | MAIN VOLUME ADJUSTMENT | L MAL | | | | R MAL | | | |
| R2 | FINE FREQUENCY ADJUSTMENT | FRQ LOW | | | | | | | |
| R3 | ROUGH FREQUENCY ADJUSTMENT | / | / | / | / | FRQ HIGH | | | |
| R4 | CHANNEL ON, CHANNEL VOLUME | ch ON | DDA | / | AL | | | | |
| R5 | L, R SOUND VOLUME | LAL | | | | RAL | | | |
| R6 | WAVEFORM, DDA | / | / | / | WAVE DATA | | | | |
| R7 | NOISE ENABLE, NOISE FREQUENCY | NE | / | / | NOISE FRQ | | | | |
| R8 | LFO FREQUENCY | LFO FRQ | | | | | | | |
| R9 | LFO CONTROL | LF TRG | / | / | / | / | / | / | LF CTL |

FIG. 3A

| R0 | 0 | 1 | 2 | 3 | 4 | 5 | 6 | 7 |
|---|---|---|---|---|---|---|---|---|
| CHANNEL | ch1 | ch2 | ch3 | ch4 | ch5 | ch6 | // | // |

FIG. 3B

| A0~A3(HEX) | 0 | 1 | 2 | 3 | 4 | 5 | 6 | 7 | 8 | 9 | A | B | C | D | E | F |
|---|---|---|---|---|---|---|---|---|---|---|---|---|---|---|---|---|
| REGISTER | R0 | R1 | R2 | R3 | R4 | R5 | R6 | R7 | R8 | R9 | / | / | / | / | / | / |

FIG. 4

| chON | DDA | MODE | OPERATION |
|---|---|---|---|
| 0 | 0 | WRITING INTO WAVEFORM REGISTER | INCREMENT OF ADDRESS AT WRITING |
| 0 | 1 | WRITING INTO WAVEFORM REGISTER | RESET OF ADDRESS COUNTER FOR WAVEFORM REGISTER |
| 1 | 0 | MIXING (SOUND OUTPUT) | ADDRESSING OF WAVEFORM REGISTER BY FREQUENCY OF FREQUENCY REGISTER |
| 1 | 1 | DIRECT D/A | RESET OF ADDRESS COUNTER, TRANSFER OF DATA TO D/A CONVERTER AT WRITING |

FIG. 5

| | 7 | 6 | 5 | 4 | 3 | 2 | 1 | 0 | INTERNAL ADDRESS |
|---|---|---|---|---|---|---|---|---|---|
| R6 | // | // | // | WAVE DATA | | | | | 0 |
| | // | // | // | | | | | | 1 |
| | // | // | // | | | | | | 2 |
| | // ⋮ // | // ⋮ // | // ⋮ // | | | | | | 3 ⋮ ID |
| | // | // | // | | | | | | 1E |
| | // | // | // | | | | | | 1F |

FIG. 9

| WAVE-FORM Hex | WAVEFORM BIT DATA | LFO DATA | WAVE-FORM Hex | WAVEFORM BIT DATA | LFO DATA | WAVE-FORM Hex | WAVEFORM BIT DATA | LFO DATA | WAVE-FORM Hex | WAVEFORM BIT DATA | LFO DATA |
|---|---|---|---|---|---|---|---|---|---|---|---|
| 1F | 11111 | +F | 17 | 10111 | +7 | F | 01111 | -1 | 7 | 00111 | -9 |
| 1E | 11110 | +E | 16 | 10110 | +6 | E | 01110 | -2 | 6 | 00110 | -A |
| 1D | 11101 | +D | 15 | 10101 | +5 | D | 01101 | -3 | 5 | 00101 | -B |
| 1C | 11100 | +C | 14 | 10100 | +4 | C | 01100 | -4 | 4 | 00100 | -C |
| 1B | 11011 | +B | 13 | 10011 | +3 | B | 01011 | -5 | 3 | 00011 | -D |
| 1A | 11010 | +A | 12 | 10010 | +2 | A | 01010 | -6 | 2 | 00010 | -E |
| 19 | 11001 | +9 | 11 | 10001 | +1 | 9 | 01001 | -7 | 1 | 00001 | -F |
| 18 | 11000 | +8 | 10 | 10000 | 0 | 8 | 01000 | -8 | 0 | 00000 | -10 |

APPARATUS FOR GENERATING SOUND THROUGH LOW FREQUENCY AND NOISE MODULATION

FIELD OF THE INVENTION

The invention relates to an apparatus for generating sound, and more particularly to an apparatus for generating sound in which sound is generated in accordance with waveform data stored in registers.

BACKGROUND OF THE INVENTION

In one of conventional apparatuses for generating sound, musical sounds are synthesized by using higher harmonics which are produced in frequency-modulation. One of the frequency-modulation methods is a feedback frequency-modulation method in which a sinusoidal wave produced in a sinusoidal table is fed back with a predetermined feedback ratio, and the sinusoidal wave thus fed back is controlled to have a predetermined phase difference to provide a sinusoidal wave having a predetermined waveform. The synthesized wave thus obtained is further controlled to have a predetermined envelope by an envelope generator.

In the conventional apparatus for generating sound, however, there are resulted in following disadvantages.

Firstly, it is difficult to generate various kinds of sounds. Especially, it is not easy to generate sounds such as rhythm sound-effects sound or effects sound-vibrato.

Secondly, it is difficult to change a waveform of output sound and store data of predetermined waveforms into a register. Further, a construction of the apparatus or software program becomes complicated in a case where a voice signal is produced in addition to an artificial sound produced by waveform data.

Thirdly, it is difficult to adjust a depth of modulation in frequency-modulation of output sound Fourthly, it is difficult to generate far and near sound in accordance with simple software program.

Fifthly, it is difficult to generate sound of a predetermined waveform, although this is concerned with the second disadvantage.

Finally, it is difficult to divide a channel sound into left and right stereo sounds.

SUMMARY OF THE INVENTION

Accordingly, it is a first object of the invention to provide an apparatus for generating sound in which various kinds of sounds including rhythm sound-effects sound or effects sound-vibrato are generated.

It is a second object of the invention to provide an apparatus for generating sound in which a waveform of output sound is changed, data of predetermined waveform is stored into a register, and a voice signal is produced without inviting the complication of a construction or software program by waveform data.

It is a third object of the invention to provide an apparatus for generating sound in which a depth of frequency-modulation of output sound can be adjusted.

It is a fourth object of the invention to provide an apparatus for generating sound in which far and near sound is generated without inviting the complication of software program.

It is a fifth object of the invention to provide an apparatus for generating sound in which sound of a predetermined waveform is generated.

It is a sixth object of the invention to provide an apparatus for generating sound in which a channel sound is divided into left and right stereo sound.

According to a feature of the invention, an apparatus for generating sound comprises, a plurality of sound generating channels each including means for storing waveform data at predetermined addresses, means for mixing output sounds of said plurality of sound generating channels, and means for controlling said means for storing to be accessed by a predetermined frequency whereby waveform data for generating one of said output sounds are read therefrom, wherein said output sounds are generated in channels selected from said plurality of sound generating channels, and then mixed in said means for mixing to provide mixed sound.

BRIEF DESCRIPTION OF DRAWINGS

The invention will be described in more detail in conjunction with appended drawings wherein, FIG. 2 is an explanatory diagram showing a group of registers in the embodiment, FIGS. 3A and 3B are explanatory diagrams showing relations between a channel selecting register and channels and between addresses and registers in the embodiment FIG. 4 is an explanatory diagram showing a relation between a content of upper two bits of a channel ON/-sound volume register and a mode and operation in the embodiment, FIG. 5 is an explanatory diagram showing a waveform register in the embodiment, FIG. 9 is an explanatory diagram showing data of addition and subtraction in frequency-modulation in the embodiment.

DESCRIPTION OF PREFERRED EMBODIMENTS

Figure 1:
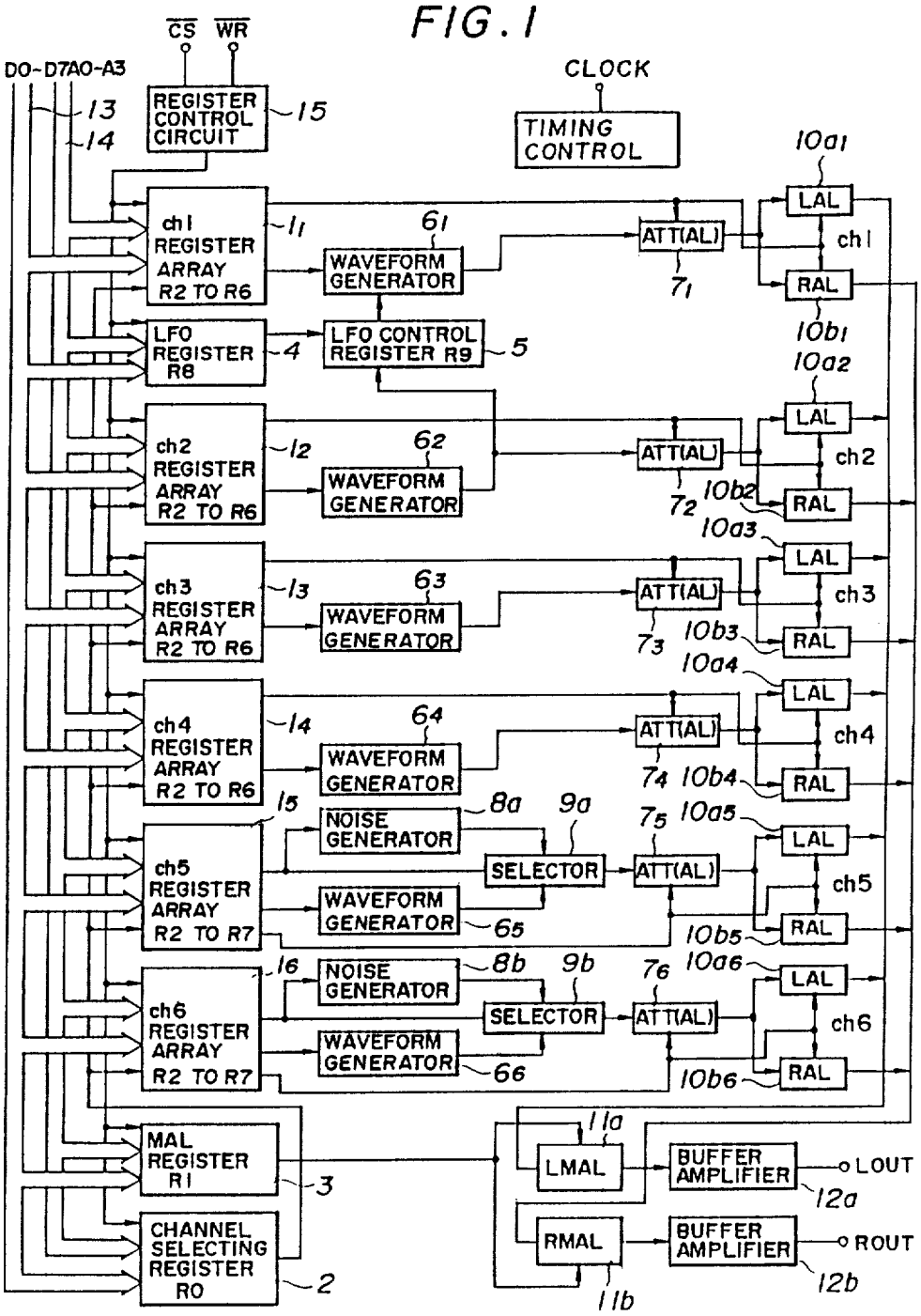
FIG. 1 is a block diagram showing an apparatus for generating sound in an embodiment according to the invention.

In FIG. 1, there is shown an apparatus for generating sound in an embodiment according to the invention in which six sound sources of channels 1 to 6 are provided. The channels 1 to 6 comprise register arrays $1_1$ to $1_6$, respectively, each including registers to be described later. The apparatus further comprises a channel selecting register (R0) 2, a main sound volume adjusting register (R1) 3, a low frequency oscillator (LFO) frequency register (R8) 4, and a low frequency oscillator (LFO) control register (R9) 5. Each of the register arrays $1_1$ to $1_6$ includes a fine frequency adjusting register (R2), a rough frequency adjusting register (R3), a channel ON/sound volume register (R4), a left and right sound volume register (R5), and a waveform register (R6). Even more, the register arrays $1_5$ and $1_6$ of the channels 5 and 6 further includes a noise enable/-noise frequency register (R7). In the channels $1_1$ to $1_4$, there are provided waveform generators $6_1$ to $6_4$ for supplying output sounds to attenuators $7_1$ to $7_4$ in which the output sounds are converted from digital signal to analog signal, and adjusted to have predetermined sound volumes. On the other hand, one of outputs of a waveform generator $6_5$ and a noise generator 8*a*, and one of outputs of a waveform generator $6_6$ and a noise generator 8*b* are selected to be supplied to attenuators $7_5$ and $7_6$ in the channels 5 and 6 by selectors 9*a* and 9*b*. Outputs of the attenuators $7_1$ to $7_6$ are divided to be supplied to left and right attenuators $10a_1$ and $10b_1$ to $10a_6$ and $10b_6$ in which the outputs are attenuated with predetermined attenuation factors to be mixed separately by left and right sounds. The left and right mixed signals are adjusted in main attenuators 11*a* and 11*b* to have predetermined sound volumes, and then passed through buffer amplifiers 12*a* and 12*b* to be supplied through output terminals LOUT and ROUT to a following stage. The register arrays $1_1$ to $1_6$, the channel selecting register (R0) 2, the main sound volume adjusting register (R1) 3, the low frequency oscillator (LFO) frequency register (R8) 4, and the low frequency control register (R9) 5 are connected through data bus D0 to D7 (eight bits) 13 and address bus A0 to A3 (four bits) 14 to CPU (not shown) thereby receiving address signals and data therefrom. Each register described above is connected to a register control circuit 15 to which a chip selecting signal CS and a writing instruction signal $\overline{WR0}$ are applied from the CPU so that data transferred through the data bus 13 from the CPU are written at an address designated by an address signal on the address bus 14 into one of the registers.

In FIG. 2, there are shown the aforementioned registers R0 to R9 each being of eight bits which will be explained as follows.

(1) channel selecting register (R0)

Channel selecting data "ch SEL" are stored in lower three bits. FIG. 3A shows a relation between channel selecting data 0 to 5 (hexadecinormal) and on of the channels 1 to 6 which is selected. For instance, if the channel selecting data are "011" (equal to "3"), the channel 4 "ch 4" is selected.

On the other hand, the registers R2 to R7 of the register arrays $1_1$ to $1_6$ and the other registers R1, R8 and R9 are addressed by the address signal A0 to A3 on the address bus 14. A relation thereof is shown in FIG. 3B. The address signal is one of the values 0 to 9 (hexadecinormal) dependent on a content of A0 to A3. For instance, if the address signal is "2" (0010), the fine frequency adjusting register R2 is selected.

(2) main sound volume adjusting register (R1)

The left and right attenuators 11*a* and 11*b* are controlled to adjust volumes of the left and right mixed sounds by the register (R1). Upper four bits "LMAL" are data for defining attenuation amount of the left attenuator 11*a*, while lower four bits "RMAL" are that for the right attenuator 11*b*. When the four bit data is "F", sound volume is the maximum, and is decreased by approximately 3 dB in a case where a set value of the register (R1) is decreased by "1".

(3) fine frequency adjusting register (R2)

Fine frequency adjusting data "FRQ LOW" of eight bits are set.

(4) rough frequency adjusting register (R3)

Rough frequency adjusting data "FRQ HIGH" of lower four bits are set. Here, data of twelve bits including the data "FRQ LOW" of eight bits as lower data and the data "FRQ HIGH" of four bits as upper data are obtained. If it is assumed that the twelve bit data are "F", a frequency $f_1$ of a waveform output is defined in each channel as follows:

$$f_1 = \frac{7.16}{2 \times 32 \times F} \text{ MHz}$$

In the above equation, "7.16 MHz" is a master frequency which is supplied from the CPU.

(5) channel ON/sound volume register (R4)

Sound output of each channel and the writing of the waveform register (R6) which will be described later are controlled in accordance with "ch ON" of the MSB, a direct D/A mode which will be described later is controlled in accordance with "DDA" of the second bit, and attenuation amounts of the attenuators $7_1$ to $7_6$ are controlled in accordance with "AL" of lower five bits FIG. 4 shows the control which is conducted in accordance with a content of the MSB and second bit of the Register (R4). As apparent from the descriptions therein, sound output is supplied from a corresponding channel in a case where the MSB is "1", while sound output is not supplied therefrom, and data on the data bus 13 are possible to be written into a corresponding waveform register (R6) in a case where the MSB "ch ON" is "0". Further, an address counter for the waveform register (R6) is reset, and a direct D/A mode is possible to be performed in a case where the second bit "DDA" is "1". The direct D/A mode is a mode in which data transferred through the data bus 13 from the CPU are passed through a corresponding one of the register arrays $1_1$ to $1_6$ and supplied directly to a corresponding one of the attenuators $7_1$ to $7_6$ without being passed through any of the waveform generators $6_1$ to $6_6$. In the corresponding attenuator, the data thus transferred are converted from digital signal to analog signal to be supplied through the output terminals LOUT and ROUT to a following stage.

The lower five bits "AL" controls attenuation amounts of the attenuators $7_1$ to $7_6$ such that the maximum output is obtained when "1F" (hexadecinormal) is set therein, and an amplitude of output is decreased by 1.5 dB each time when a set value is decreased by "1".

(6) left and right sound volume register (R5)

In each channel, the register (R5) controls a corresponding pair of the attenuators $10a_1$ and $10b_1$ to $10a_6$ and $10b_6$ for adjusting left and right dividing sound volumes. Sound volume of left output is decided by upper four bits "LAL", while that of right output by lower four bits "RAL". When the "LAL" or "RAL" is "F" (hexadecinormal), the sound volume is the maximum, and is decreased by approximately 3 dB each time when a set value is decreased by "1".

(7) waveform register (R6)

The waveform register (R6) is shown in FIG. 5 in which a word is composed of lower five bits for setting waveform data. As shown therein, the register (R6) includes thirty-two addresses "0", "1", "2", ... "1E", "1F" (hexadecinormal), and thirty-two waveform data corresponding to the addresses and defining one period of a waveform. Therefore, the thirty-two addresses are accessed in an order of address numbers by a predetermined frequency and number so that a sound signal of a predetermined frequency is produced in a corresponding one of the waveform generators $6_1$ to $6_6$.

Figure 6:
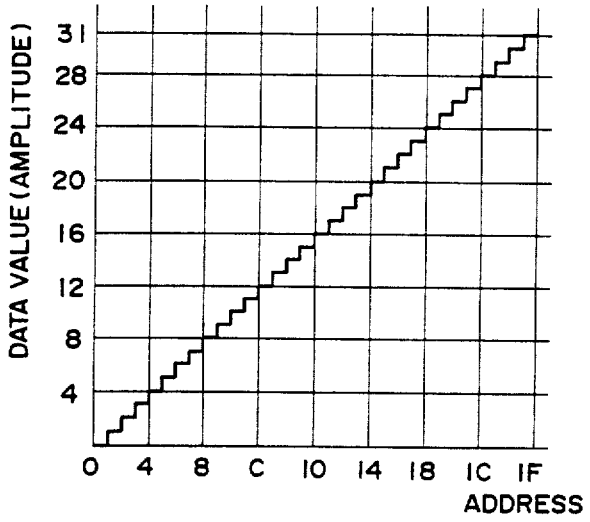
FIG. 6 is an explanatory diagram showing a pattern of a relation between addresses and waveform data in the waveform register in the embodiment.

In FIG. 6, there is shown a relation between an address (horizontal axis) and an amplitude (vertical axis) in which the amplitude is increased from "0" to "31" by one each time when the address is increased from "0" to "1F" by one. In a case where a waveform register having data as shown in FIG. 6 is accessed in an order of address numbers by a predetermined frequency, a saw-tooth wave sound is generated.

Figure 7:
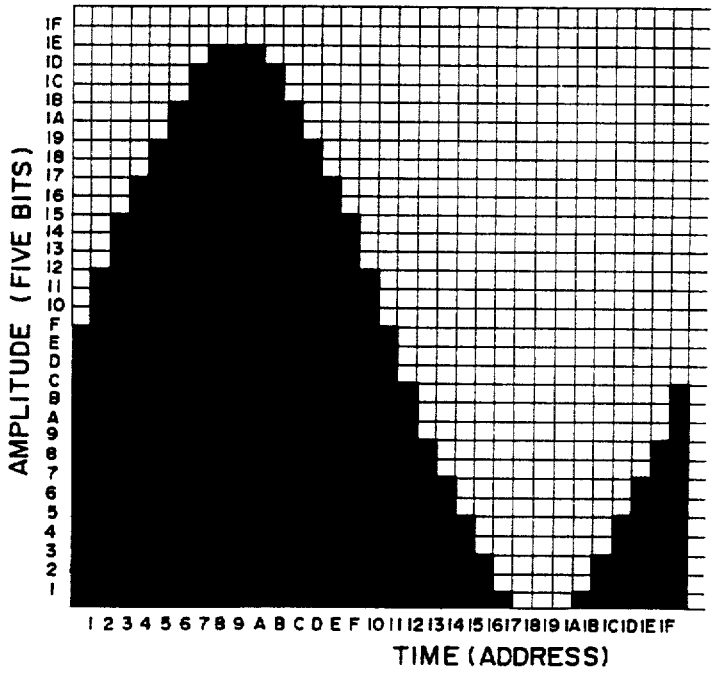
FIG. 7 is an explanatory diagram showing a data conversion for storing a sinusoidal waveform into the waveform register in the embodiment.

FIG. 7 shows a data conversion in which a sinusoidal waveform of one period is divided equally by thirty-two addresses so that thirty-two amplitudes corresponding to the thirty-two addresses are expressed by five bit words which are stored into the waveform register (R6). Accordingly, when the waveform register (R6) is addressed in an order of address numbers, a waveform pattern as shown in FIG. 7 is generated in a corresponding one of the waveform generators $6_1$ to $6_6$. In a case where sound other than a sinusoidal waveform is generated, a waveform of the sound is observed in a waveform observing apparatus such as a synchroscope thereby being converted in regard to data thereof in the same manner as described in a case of a sinusoidal waveform.

The converted data are written into the waveform register (R6) in a following procedure. As explained in the channel ON/sound volume register (R4) in FIG. 4, a mode in which an address of the waveform register (R6) is increased by one each time when data are written thereinto in a case where both the upper two bits of the register (R4) are "0" ("ch ON" is "0", and "DDA" is "0"). Thus, thirty-two words (thirty-two waveform data) are written into the thirty-two addresses thereof. At this stage, one of the channels 1 to 6 is selected by the channel selecting register (R0) 2, and address data "A0 to A3" of the address bus 14 is controlled to be "6" so that data are transferred through the data bus 13 from CPU to the waveform register (R6). When data are finished to be written thereinto, the upper two bits of the register (R4) are controlled to be "10" ("ch ON" is "1", and "DDA" is "0") to provide an output mode. When the starting address of the waveform register (R6) is wanted to be "0" at the moment that data are begun to be written thereinto, the upper two bits of the register (R4) are set to be "00" after the bits are once set to be "01". Thus, an address counter for the waveform register (R6) is reset to be "0" in accordance with the control of software program.

In the aforementioned direct D/A mode, on the other hand, a preparation for generating sound is completed when the upper two bits of the register (R4) are set to be "00", "00" is written into the waveform register (R6), and the upper two bits of the register (R4) are then set to be "11". In the circumstance, when data are repeated to be written into the waveform register (R6), sound is generated because data are transferred to a corresponding one of the attenuators $7_1$ to $7_6$ (D/A converters) at each time of the data writing. In this case, although data are transferred to the waveform register (R6), the data may be considered to be passed therethrough. That is to say, a content of the register (R6) remains unchanged to be maintained therein. By adopting this mode, a voice can be supplied through the apparatus from the CPU to a following stage in place of an artificial sound supplied from the waveform register (R6).

(8) noise enable/noise frequency register (R7)

A change-over between noise sounds and musical sounds is controlled by the MSB bit "NE". When the "NE" is "1", the noise sounds are enabled to cease output of the musical sounds. Noise frequency is controlled by lower five bits. As described before, the noise generators 8*a* and 8*b* are provided in the channels 5 and 6. For this reason, the register (R7) is provided only in each of the channels 5 and 6. In the control of noise frequency, clock signal which is supplied to the noise generators 8*a* and 8*b* is controlled such that sound is shifted from low frequency to high frequency when a content of the lower five bits is varied from "0" to "1F". The noise frequency $f_2$ is defined as follows:

$$f_2 = \frac{7.16}{2 \times 32 \times 2 \times NF} \text{ MHz}$$

Where "NF" is a content of the lower five bits of the register (R7). The noise sound is a waveform of pseudo random, and output waveform is a rectangle wave which is applied to the generating of rhythm sound-effects sound.

(9) low frequency oscillator (LFO) frequency register (R8) 4

A low frequency oscillator (LFO) is used for the control of frequency-modulation, and is composed of the register (R8) 4 and a frequency counter for musical sounds in the channel 2. Here, it is defined that the frequency-modulation is a frequency-modulation in which sound of the channel 1 is frequency-modulated by using a waveform data of the channel 2. A frequency $f_3$ of the low frequency oscillator (LFO) is controlled by the register (R8) 4, and the fine frequency adjusting register (R2) and the rough frequency adjusting register (R3) in the channel 2. Effects sound-vibrato is generated in accordance with the frequency modulation.

(10) low frequency oscillator (LFO) control register (R9) 5

The register (R9) 5 includes the MSB "LF TRG" and lower two bits "LF CTL". A low frequency oscillator (LFO) is reset to return to the initial state when "1" is written into the "LF TRG". At this stage, a content at the address "0" of the waveform register (R6) in the channel 2 is an output which is used as frequency-modulation data, and the frequency-modulation is then stopped. While, the frequency-modulation is started when the "LF TRG" is "0". That is to say, sound of the channel 1 is frequency-modulated by waveform data of the waveform register (R6) in the channel 2 to generate effects soundvibrato.

Figure 8:
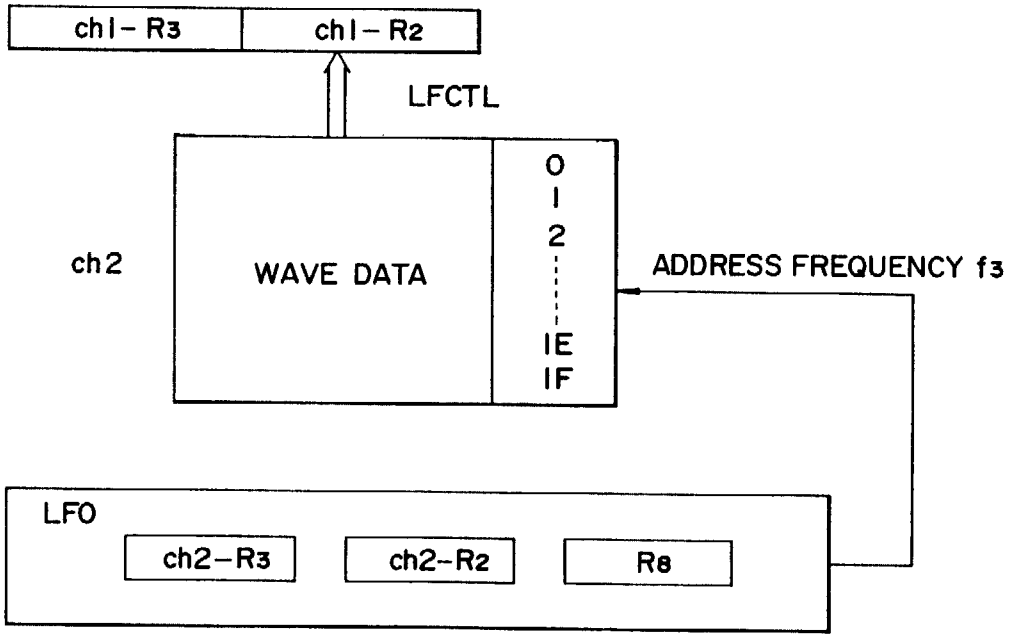
FIG. 8 is an explanatory diagram showing a mode of frequency-modulation of output sound in the embodiment.

The lower two bits "LF CTL" controls a modulation degree of the frequency-modulation. FIG. 8 shows a relation between the low frequency oscillator (LFO) and the frequency-modulation. A frequency $f_3$ of the low frequency oscillator (LFO) which is an address frequency for addressing the waveform register (R6) in the channel 2 is defined as follows:

$$f_3 = \frac{7.16}{2 \times 32 \times F \times F'} \text{ MHz}$$

Where F' is data value (decimal) of twelve bits including eight bit data of the register (R2) in the channel 2 as lower data and four bit data of the register (R3) as upper data, and F'' is data value (decimal) of eight bits of the low frequency oscillator (LFO) register (R8) 4. The frequency-modulation of the channel 1 is performed by data of the waveform register R6 which is addressed in the channel 2 by the address frequency $f_3$. That is to say, data of the waveform register (R6) in the channel 2 are added to or subtracted from the fine frequency adjusting register (R2) in the channel 1.

FIG. 9 shows frequency-modulation data (LFO data) corresponding to waveform data of waveform "0" to "1F" of the waveform register (R6) in the channel 2 whereby addition is performed in a case where the MSB of the waveform data is "1" (the waveform from "10" to "1F"), while subtraction is performed in a case where the MSB of the waveform data is "0" (the waveform "0" to "F"). Sound of the channel 1 is shifted in a direction of low frequency by the addition, and in a direction of high frequency by the subtraction. For instance, when the waveform data of an address which is addressed in the waveform register (R6) of the channel 2 are "11100", lower four bits "1100" (=C) of the waveform data "11100" are added to four corresponding bits of the fine frequency adjusting register (R2) of the channel 1.

Figure 10A:
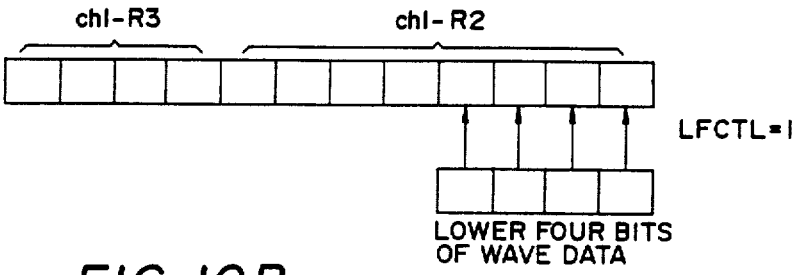
FIGS. 10A, 10B and 10C are explanatory diagrams showing a mode in which addition and subtraction are performed between frequency data of output sound and frequency modulated data in the embodiment.
Figure 10B:
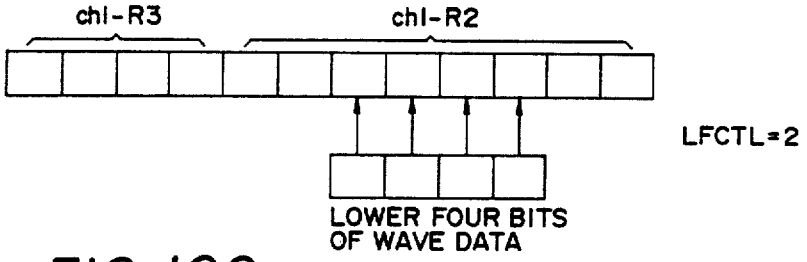
Figure 10C:
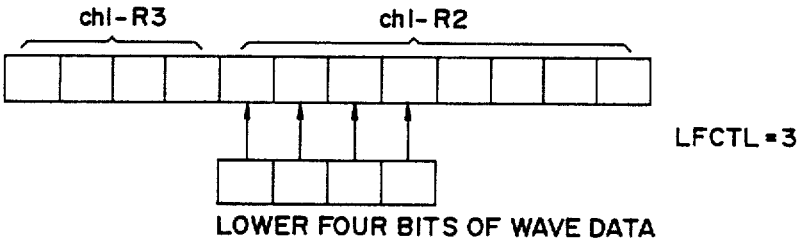

FIGS. 10A to 10C show four bits of the fine frequency adjusting register (R2) in the channel 1 to which the aforementioned lower four bits of the waveform data are added. That is to say, four bits of positions decided by a content of the lower two bits "LF CTL" of the low frequency oscillator (LFO) control register (R9) 5 are selected in the fine frequency adjusting register (R2) as follows:

(a) "LF CTL"="0"

The low frequency oscillator (LFO) is turned off, and output of normal musical sound is obtained.

(b) "LF CTL"="1"

Lower four bits of the waveform register (R6) of the channel 2 are added to or subtracted from lower four bits of the fine frequency adjusting register (R2) of the channel 1 to provide data by which a frequency of sound of the channel 1 is decided a shown in FIG. 10A.

(c) "LF CTL"="2"

The lower four bits of the register (R6) of the channel 2 are added to or subtracted from middle four bits of the register (R2) of the channel 1 as shown in FIG. 10B.

(d) "LF CTL"="3"

The lower four bit of the register (R6) of the channel 2 are added to or subtracted from upper four bits of the register (R2) of the channel 1 as shown in FIG. 10C.

Figure 11:
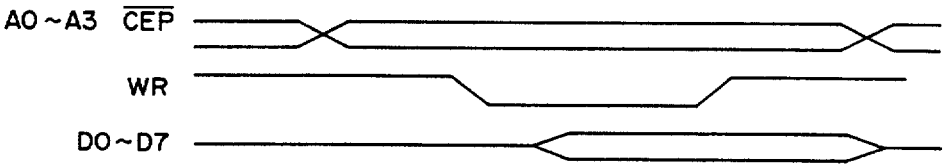
FIG. 11 is a timing chart showing a timing at which data are written into a register.

FIG. 11 shows a timing at which data are set in the registers (R0 to R9). Data are set in one of the registers R0, R1, R8 and R9 wherein a chip is enabled in accordance with "0" of $\overline{CEP0}$ signal, one of the registers is selected in accordance with the address A0 to A3 of the address bus 14, and data D0 to D7 which are set on the data bus 13 are written thereinto in accordance with "0" of the writing signal $\overline{WR}$. On the other hand, data are set in one of the registers R2 to R7 wherein one of the channels 1 to 6 is set in the channel selecting register R0, and the same procedure as described above is thereafter performed to write data into a register in a channel thus selected.

Next, operations will be explained in the apparatus for generating sound in the embodiment according to the invention.

[OPERATION 1]

It is assumed that predetermined data are already written in the registers (R0 to R9). In the circumstance, the whole system in the apparatus is enabled when the chip selecting signal $\overline{CS0}$ (="0") is applied to the register control circuit 15. When at least one of the channels and those of the registers are selected in accordance with a content of the channel selecting register (R0) and an address A0 to A3 on the address bus 14, the addresses "0" to "1F" of the waveform register (R6) are addressed in accordance with a frequency dependent on contents of the fine frequency adjusting register (R2) and the rough frequency adjusting register (R3) in the channel where the upper two bits of the channel ON/-sound volume register (R4) are "10" so that output sound is generated in at least one of the waveform generators $6_1$ to $6_6$ in which waveform data of the waveform register (R6) are developed. The attenuation amounts of the attenuators $7_1$ to $7_6$ are set to be predetermined values in accordance with the lower four bits of the channel ON/sound volume register (R4), and the attenuation amounts of the attenuators $10a_1$ and $10b_1$ to $10a$ and $10b_6$ are set by the left and right (LR) sound volume register (R5). Output sound of each channel is converted from digital signal to analog signal in a corresponding one of the attenuators $7_1$ to $7_6$, and are adjusted to be a predetermined sound volume therein. The output sound is divided in each channel to be supplied to a corresponding pair of the attenuators $10a_1$ and $10b_1$ to $10a_6$ and $10b_6$, and the output sounds thus divided are mixed to provide left and right output sounds which are then controlled in the left and right main attenuators 11a and 11b set by the main sound volume adjusting register (R1) thereby providing the left and right output sounds with predetermined main sound volumes. The left and right stereo sounds of the main volumes thus adjusted are passed through the buffer amplifiers 12a and 12b to be supplied through the output terminals LOUT and ROUT to a following stage.

In the operation described above, when the MSB of the noise enable noise/frequency register (R7) is "1" in the channels 5 and 6, noise is generated in the noise generator 8a or 8b in accordance with a noise frequency of the lower five bits of the register (R7), and then selected to be supplied to the attenuator $7_5$ or $7_6$ by the selectors 9a or 9b thereby producing rhythm sound-effects sound.

Further, the MSB of the low frequency oscillator (LFO) control register (R9) is changed from "1" to "0", frequency-modulation of output sound is started in the channel 1 again. At this moment, an address frequency $f_3$ by which the waveform register (R6) is addressed is decided by a content of the low frequency oscillator (R9) and contents of the fine and rough frequency adjusting registers (R2 and R3). In accordance with the access of the waveform register (R6), lower four bits of the waveform register (R6) are added to or subtracted from selected four bits of the fine frequency adjusting register (R2) in the channel 1 dependent on the "LF CTL" (lower two bits) of the low frequency oscillator (LFO) control register (R9) to result in frequency-modulation of output sound thereby producing effects sound-vibrato.

On the other hand, when upper two bits of the channel ON/sound volume register (R4) are "11", there is realized a direct D/A mode in which voice sound is supplied from the CPU through the data bus 13 to at least a corresponding one of the register arrays 11 to $1_6$ each time when the writing signal $\overline{WR0}$ is applied to the register control circuit 15 in accordance with the resetting of the address counter for the waveform register (R6) to be transferred through a line which does not pass on a corresponding one of the waveform generators $6_1$ to $6_6$ to at least a corresponding one of the attenuators $7_1$ to $7_6$ in which voice sound is converted from digital signal to analog signal, and adjusted to be a predetermined sound volume thereby being supplied through the output terminals LOUT and ROUT in the same manner as described above. This results in the generation of voice sound which is utilized for effects sounds in place of artificial sound.

As apparent from the explanations, simultaneous generation of six musical sounds and of four musical sounds and two noise sounds and so on can be performed, although the number of waveform generators and noise generators is not limited to that of the embodiment.

[OPERATION 2]

An address A0 to A3 of the address bus 14 are controlled to be "0000", and the channel selecting register (R0) is addressed from the CPU as shown in FIG. 3B. In the circumstance, "0" is written into lower three bits "ch SEL" thereof from the data bus 13 so that the channel 1*b* is selected as shown in FIG. 3A. Next, the address A0 to A3 are controlled to be "0100", and the channel ON/sound volume register (R4) is addressed in the channel 1. Under the situation, predetermined data are written into upper two bits "ch ON" and "DDA" of the register (R4) to conduct following operations.

(a) "ch ON"="0", and "DDA"=0

The waveform register (R6) is addressed in accordance with an address "0111" on the address bus 14. The addresses of the waveform register (R6) are serially addressed, when a counted value of the internal address counter is increased by one as shown in FIG. 5, so that waveform data transferred through the data bus 13 ar written thereinto. Such waveform data can be stored in the waveform register (R6) by performing a data conversion of a predetermined waveform as explained before. In this case, the writing of waveform data is started from a non-fixed address dependent on a then-counted value of the internal address counter.

(b) "ch ON"="0", and "DDA"=1

After upper two bits of the register R4 are set as "0" and "1", the two bits are set to be "0" and "0" so that the address counter for the register R4 is reset to be "0". Thereafter, data are written thereinto in an order of the addresses "0" to "1F". Thus, waveform data can be written into the waveform register (R6) in the channel 1. After the upper two bits of the channel ON/sound volume register (R4) are set to be "1" and "0", respectively, so that output sound of the channel 1 is converted from analog signal to digital signal in the attenuator $7_1$ and adjusted to have a predetermined sound volume, and then divided to be supplied to the attenuators $10a_1$ and $10b_1$ from which left and right output sounds of the channel 1 are supplied to the main attenuators 11*a* and 11*b*.

On the other hand, "0" (="ch ON") and "1" (="DDA") are written through the data bus 13 into the upper two bits of the channel ON/sound volume register (R4), and "00" are written into the waveform register (R6) so that the direct D/A mode is demanded. Thereafter, "1" (="ch ON") and "1" (="DDA") are written into the upper two bits of the register (R4) so that voice sound signals which are transferred through the data bus 13 are repeated to be written into the waveform register (R6), and supplied to the attenuator (D/A converter) $7_1$ through a path which does not pass the waveform generator (R6) to provide voice sound output at each time of the writing of the waveform register (R6). In this case, although data are seemingly transferred to the waveform register (R6), a whole content of the waveform register (R6) is held to remain unchanged.

Although the operation of the channel 1 is explained above, the same operation is possible to be performed in the other channels 2 to 6 or in a plurality thereof simultaneously.

[OPERATION 3]

When lower two bits "LF CTL" of the low frequency oscillator control register (R9) are not zero, that is, the bits are one of "1", "2" and "3", a low frequency oscillator is turned on to produce a low frequency signal $f_3$. The frequency $f_3$ is calculated in the aforementioned equation, and depends on contents of the fine and rough frequency register (R2 and R3) and on a content of the low frequency oscillator (LFO) frequency register (R8). When "1" is written into the MSB "LF TRG" of the low frequency oscillator (LFO) control register (R9) 5, the low frequency oscillator (LFO) is reset to return to the initial state. At this moment, frequency-modulation is stopped in a state that waveform data at the address "0" of the waveform register (R6) in the channel 2 is read out as frequency-modulation data. In the circumstance, "0" is written into the MSB "LF TRG" of the control register (R9), frequency-modulation is started again with the low frequency signal $f_3$ by which the waveform register (R6) of the channel 2 is serially addressed from the address "0" to the address "1F". If the low frequency $f_3$ is high, an addressing speed is of a high speed, while the addressing speed is low if the low frequency $f_3$ is low. Waveform data of the waveform register (R6) in the channel 2 are accessed in an order of the addresses "0" to "1F" so that lower four bits of the waveform data are added to or subtracted from selected four bits of the fine frequency adjusting register (R2). At this moment, when the upper bit of the five bit waveform data is "1", addition is performed, and when the upper bit is "0", subtraction is performed. Here, when lower two bits "LF OTL" of the low frequency oscillator (LFO) control register (R9) is "01", addition or subtraction is performed as shown in FIG. 10A, and when the "LF CTL" is "10" and "11" respectively, addition or subtraction is correspondingly performed as shown in FIGS. 10B and 10C. In this case, modulation degree is larger in FIG. 10B than in FIG. 10A, and larger in FIG. 10C than in FIG. 10B. In this manner, when waveform data of the waveform register (R6) in the channel 2 are added to a content of the fine frequency adjusting register (R2) in the channel 1, output sound of the channel 1 is frequency-modulated by the result of the addition or subtraction and a content of the rough frequency adjusting register (R3) thereby producing output sound of effects sound-vibrato in the channel 1.

[OPERATION 4]

A mixing mode is set when "10" are set into upper two bits "ch ON" and "DDA" of the channel ON/-sound volume register (R4) in each of the channel 1 to 6 where the waveform register (R6) is addressed with a frequency decided by the frequency adjusting registers (R2 and R3) so that output sound is generated in each of the waveform generators $1_1$ to $1_6$ of the channels 1 to 6. The output sound is converted from digital signal to analog signal and adjusted to be a predetermined sound volume decided by lower five bits "AL" of the channel ON/sound volume register (R4) in each of the attenuators $7_1$ to $7_6$. The output sound of the predetermined sound volume is than divided to be supplied to each left and right pair of the attenuators $10a_1$ and $10b_1$ to $10a_6$ and $10b_6$ in which the output sound is adjusted to be predetermined levels in accordance with contents of upper four bits "LAL" and lower four bits "RAL" of the left and right sound volume register (R5). Therefore, left output sounds of the attenuators $10a_1$ to $10a_6$ and right output sounds of the attenuators $10b_1$ to $10b_6$ are separately mixed with each other to be supplied to the left and right main attenuators 11*a* and 11*b* in which the whole left and right sounds are adjusted in regard to sound volume to be supplied through the buffer amplifiers 12*a* and 12*b* to the output terminals LOUT and ROUT. As a result, the left and right sound outputs of predetermined sound volumes are obtained at the output terminals LOUT and ROUT. The attenuation amounts of the left and right main attenuators 11*a* and 11*b* are decided by the upper four bits "LMAL" and the lower four bits "RMAL" of the main sound volume register (R1). Accordingly, when it is assumed that the maximum sound volume is "F" (hexadecinormal), far and near sounds are generated in accordance with contents of the "LMAL" and "RMAL".

[OPERATION 5]

Upper two bits "ch ON" and "DDA" of the channel ON/sound volume register (R4) are set as "10" in a corresponding channel so that a mixing mode is set to address the waveform register (R6) with a frequency decided by the fine and rough frequency adjusting registers (R2 and R3). As shown in FIG. 5, waveform data are stored at the addresses "0" to "1F" of the waveform register (R6) so that waveform data are developed in an order of addresses at each time when a counted value of the address counter for counting address frequency is increased by one thereby producing waveform in a corresponding one of the waveform generators $6_1$ to $6_6$. In the corresponding channel, output sound is generated by repeating the addressing of the waveform register (R6) in a period of a waveform thus produced. Waveform of each channel is converted from digital signal to analog signal and adjusted to be a predetermined sound volume in each of the attenuators $7_1$ to $7_6$, and divided to be supplied to each pair of the left and right attenuators $10a_1$ and $10b_1$ to $10a_6$ and $10b_6$ in which left and right sounds are separately adjusted to be predetermined sound volumes. The left sounds of the channels are mixed to be supplied to the left main attenuator 11*a*, and the right sounds of the channels are mixed to be supplied to the right main attenuator 11*b*. The left and right sounds thus mixed are adjusted therein to be predetermined sound volumes and supplied through the buffer amplifiers 12*a* and 12*b* to the output terminals LOUT and ROUT.

The sound volume adjustment of the respective attenuators is performed in accordance with contents of the main sound volume adjusting register (R1), the channel ON/sound volume register (R4), and the left and right sound volume register (R5). As described before, output sound volume is changed by 3 dB when contents of the register (R1 and R5) are changed by one, and the former is changed by 1.5 dB when the latter is changed by one.

Here, it is assumed that contents of the registers are as follows:

(a) main sound volume adjusting register (R1)
"LMAL" is "C" (hexadecinormal)
"RMAL" is "8" (hexadecinormal)

(b) channel ON/sound volume register (R4)
upper four bits of "AL" are "E" (hexadecinormal)
sound volume is controlled in accordance with lower one bit of "AL" by 1.5 dB .

(c) left and right sound volume register (R5)
"LAL" is "F" (hexadecinormal)
"RAL" is "8" (hexadecinormal)

In accordance with the above assumptions, an attenuation value of the left output value will be calculated as follows because the maximum sound value is "F".

$$(F-C)+(F-E)+(F-F)=4$$

$$4\times 3\text{ dB}=12\text{ dB}$$

Accordingly, a level down of 12 dB is resulted.

On the other hand, an attenuation value of the right output value will be calculated as follows:

$$(F-8)+(F-E)+(F-8)=15$$

$$15\times 3\text{ dB}=45\text{ dB}$$

Accordingly, a level down of 45 dB is resulted. Here, if it is assumed that a dynamic range is 45 dB in a circuit, no output sound is obtained at the right output terminal ROUT.

Further, the main sound volume adjusting register (R1) can be used for fade in and fade out of a whole sound and for a left to right shift of the whole sound, while the channel ON/sound volume register (R4) can be used for an output level adjustment of a channel sound, and the left and right sound volume register (R5) can be used for a left and right distribution of a channel sound and for an output level adjustment of the channel sound.

[OPERATION 6]

The channel selecting register (R0) is addressed in accordance with an address signal "0" (A0 to A3) on the address bus 14 so that data for selecting one of the channels 1 to 6 are set into lower three bits thereof. If the data are "0", the channel 1 is selected. Next, the left and right sound volume register (R5) is addressed by address data "5" (A0 to A3) so that sound volume adjusting data are set into upper and lower four bits "LAL" and "RAL" respectively. Thus, sound volume adjusting levels are set into the left and right attenuators $10a_1$ and $10b_1$ to $10a_6$ and $10b_6$ of the channel 1 to 6. When upper two bits "ch ON" and "DDA" of the channel ON/sound volume register (R4) are set to be "10" in each channel, a mixing mode is set to address the waveform register (R6) with an address frequency decided by the frequency registers (R2 and R3). In accordance with the addressing of the waveform register (R6), waveform data are developed in the waveform generators $6_1$ to $6_6$ to produce output sounds which are converted from digital signals to analog signals and adjusted to be predetermined sound volumes in the attenuators $7_1$ to $7_6$. The output sounds of the attenuators $7_1$ to $7_6$ are divided to be supplied to the left and right attenuators $10a_1$ and $10b_1$ to $10a_6$ to $10b_6$ in which predetermined attenuation amounts decided by the left and right sound volume register (R5) are given to output sounds of the channels. Thereafter, output sounds are supplied through the output terminals LOUT and ROUT to a following stage in the same manner as described before, although repeated explanations ar omitted here.

Although the invention has been described with respect to specific embodiment for complete and clear disclosure, the appended claims are not to thus limited but are to be construed as embodying all modification and alternative constructions that may occur to one skilled in the art which fairly fall within the basic teaching herein set forth.

What is claimed is:

1. An apparatus for generating sound comprising:

a plurality of sound generating channels each including means for storing waveform data at predetermined addresses, means for mixing output sounds of said plurality of sound generating channels, means for controlling said means for storing to be accessed by a predetermined frequency whereby waveform data for generating one of said output sounds are read therefrom, wherein said output sounds are generated in channels selected from said plurality of sound generating channels, and then mixed in said means for mixing to provide mixed sound, means for producing a low frequency signal in accordance with frequency control data stored in a register included in a first channel and frequency data of a frequency counter for output sound in a second channel, and means for adding or subtracting said waveform data read from said means for storing in said second channel by an address frequency of said low frequency signal to or from frequency data of output sound which is now generated thereby producing frequency data for modulation, wherein said means for controlling modulates said output sound which is now generated in accordance with said frequency data for modulation.

2. An apparatus for generating sound comprising:

a plurality of sound generating channels, each of said sound generating channels including means for storing waveform data at predetermined addresses and a waveform generator for generating an output sound in accordance with said data read from said waveform data storing means, at least one of said sound generating channels comprising means for storing noise data and a noise generator for generating an output noise in accordance with said noise data read from said noise data storing means, said noise generator being in parallel relationship with said waveform generator in said at least one channel, at least one selector for selecting one of said waveform generator and said noise generator in said at least one channel, said at least one channel generating an output sound or an output noise in accordance with the selection of said at least one selector, and means for mixing the outputs of said at least one channel and the output sounds of the remaining channels.

* * * * *